US007546654B2

(12) United States Patent
Carmel

(10) Patent No.: US 7,546,654 B2
(45) Date of Patent: Jun. 16, 2009

(54) MOBILE COMPRESSION AND TENSION BRIDGE AND SHELTER STRUCTURE

(76) Inventor: Mordehay Carmel, 2222 Foothill Bl., Ste. E241, La Canada, CA (US) 91011

( * ) Notice: Subject to any disclaimer, the term of this patent is extended or adjusted under 35 U.S.C. 154(b) by 0 days.

(21) Appl. No.: 11/501,365

(22) Filed: Aug. 8, 2006

(65) Prior Publication Data

US 2007/0234490 A1 Oct. 11, 2007

Related U.S. Application Data

(60) Provisional application No. 60/785,659, filed on Mar. 23, 2006.

(51) Int. Cl.
*E01D 15/12* (2006.01)

(52) U.S. Cl. ..... 14/2.4; 14/2.5; 14/2.6; 14/24

(58) Field of Classification Search ..... 14/2.4, 14/2.5, 2.6, 24; 404/35
See application file for complete search history.

(56) References Cited

U.S. PATENT DOCUMENTS

| | | | | | |
|---|---|---|---|---|---|
| 305,328 | A | * | 9/1884 | Peck | 404/37 |
| 2,784,464 | A | * | 3/1957 | Wilhelm | 160/231.2 |
| 2,874,812 | A | * | 2/1959 | Clevett, Jr. | 52/223.7 |
| 2,877,506 | A | * | 3/1959 | Almoslino | 52/223.7 |
| 3,134,116 | A | * | 5/1964 | Adkins et al. | 14/2.6 |
| 3,252,173 | A | | 5/1966 | Robinsky | |
| 3,258,800 | A | | 7/1966 | Robinsky | |
| 3,496,586 | A | * | 2/1970 | Kaufman | 14/27 |
| 3,559,361 | A | * | 2/1971 | Sarros | 52/742.14 |
| 3,912,408 | A | * | 10/1975 | Domnick | 404/35 |
| 3,913,291 | A | * | 10/1975 | Dulien et al. | 52/396.04 |
| 4,047,257 | A | * | 9/1977 | Bondarchuk, Sr. | 14/27 |
| 4,284,094 | A | * | 8/1981 | Behrend | 135/123 |
| 4,353,190 | A | * | 10/1982 | Gleeson | 52/223.12 |
| 4,442,149 | A | * | 4/1984 | Bennett | 428/53 |
| 4,561,376 | A | * | 12/1985 | Fitzgerald-Smith | 114/267 |
| 4,601,079 | A | | 7/1986 | Corica | |
| 4,681,482 | A | | 7/1987 | Arciszewski et al. | |
| 4,727,696 | A | * | 3/1988 | Henriques da Trindade | 52/223.7 |
| 4,839,935 | A | * | 6/1989 | Calcagni et al. | 14/24 |
| 4,890,437 | A | * | 1/1990 | Quaile | 52/690 |
| 4,964,751 | A | * | 10/1990 | Rope et al. | 404/35 |
| 5,097,558 | A | * | 3/1992 | Accorsi et al. | 14/73 |
| 5,282,692 | A | * | 2/1994 | McLeod | 404/35 |
| 6,381,792 | B1 | | 5/2002 | Woodfin | |
| 6,446,292 | B1 | | 9/2002 | Fuessinger et al. | |
| 6,463,613 | B1 | | 10/2002 | Thompson | |
| 6,874,972 | B2 | * | 4/2005 | Davis et al. | 404/35 |
| 6,892,409 | B1 | | 5/2005 | Kaup et al. | |
| 6,928,959 | B1 | | 8/2005 | Trauernicht et al. | |

* cited by examiner

*Primary Examiner*—Gary S Hartmann
(74) *Attorney, Agent, or Firm*—Dennis G. LaPointe

(57) ABSTRACT

A mobile compression and tension bridge and shelter structure having a plurality of individual structural elements that are parallel to each other and perpendicular to the length of the bridge or shelter. The structural elements are flexibly connected to one another on a bottom surface forming an arch caused by the shape of the elements or by placing spacers between the elements with at least one tension device attached to each structural element.

17 Claims, 11 Drawing Sheets

MOBILE COMPRESSION AND TENSION BRIDGE AND SHELTER STRUCTURE

CROSS-REFERENCE TO RELATED APPLICATION(S)

This application claims the benefit of U.S. Provisional Patent Application No. 60/785,659, filed Mar. 23, 2006, the disclosure of which is hereby incorporated by reference herein.

FIELD OF THE INVENTION

This invention relates to devices for building shelters to span between walls or to rest directly on the ground, and for bridging obstacles to enable pedestrians and vehicles to traverse the obstacles. More particularly, this invention relates to a portable structure, or bridge, comprising a plurality of elements connected to one another by a tension device.

BACKGROUND OF THE INVENTION

This invention was intended to fulfill the need for easily transportable structures, simple in design, and able to be quickly erected as a bridge and/or shelter. Such shelter or bridge would satisfy the demand for emergency and rescue operations where instant bridges or shelters are necessary. The army requires light mobile bridges that can be speedily erected and light structures to facilitate storage and shelter for soldiers and equipment.

Existing military mobile bridge solutions are bulky, costly and heavy to transport. For example, the Armored Vehicle Launcher (AVLB), the XM104 Wolverine and the Leguan Bridge are not lightweight structures that are simple to construct and transport. Previously available lightweight mobile bridge structures are not designed or capable of carrying heavy loads like cars, tanks and trailers.

Consequently, a need exists for an improved mobile bridge or shelter structure which is simple to construct, mobile, lightweight and inexpensive to manufacture.

SUMMARY OF THE INVENTION

The present invention is directed to a lightweight shelter, roof or bridge structure which is mobile and easily erected. The structure is made of a plurality of elements which could be poles or tubes having a cross-sectional shape of a square, U-shaped, triangle, rectangle, trapezoids, circle, I-beam or any combination thereof. The elements are produced from plastic, polymers, wood or metal. The elements are laid together and the lower surfaces of the elements are connected by a tension device which could be cables, mesh or straps. The entire structure can be folded or rolled into a cylindrical shape for mobility.

The structure of the present invention is a low cost, self-contained unit which may be carried on a truck bed, trailer, tractor, tank or ship and transported very easily to any desired location. The device is designed in such a way that the bridge elements can move relative to one another, and, for example, could be rolled upon itself or around a reel for transport. Accordingly, the device does not occupy a large space. The bridge structure or shelter can be designed for use by pedestrians, civilian or military vehicles, including tractors and tanks. An advantage of the present invention is that it can be erected in a very short time as once the structure is unrolled and supported at both of its ends, it is ready for service. Another advantage of the present invention is that the device is a self-contained unit, and once it is erected it can be operated without an outside power source, and requires little or no maintenance. The bridge structure can be extended to any desired length in proportion to the size of its individual elements and tension device. The device does not require a large crew to transport or operate and can be used on land or span over water. The device is portable and has an excellent strength-to-weight ratio and can be quickly deployed without the use of any additional supports.

BRIEF DESCRIPTION OF THE DRAWINGS

The invention is described in more detail herein with reference to the accompanying drawings, wherein like reference characters refer to the same parts throughout the several views and in which.

DETAILED DESCRIPTION OF THE INVENTION

Figure 1:
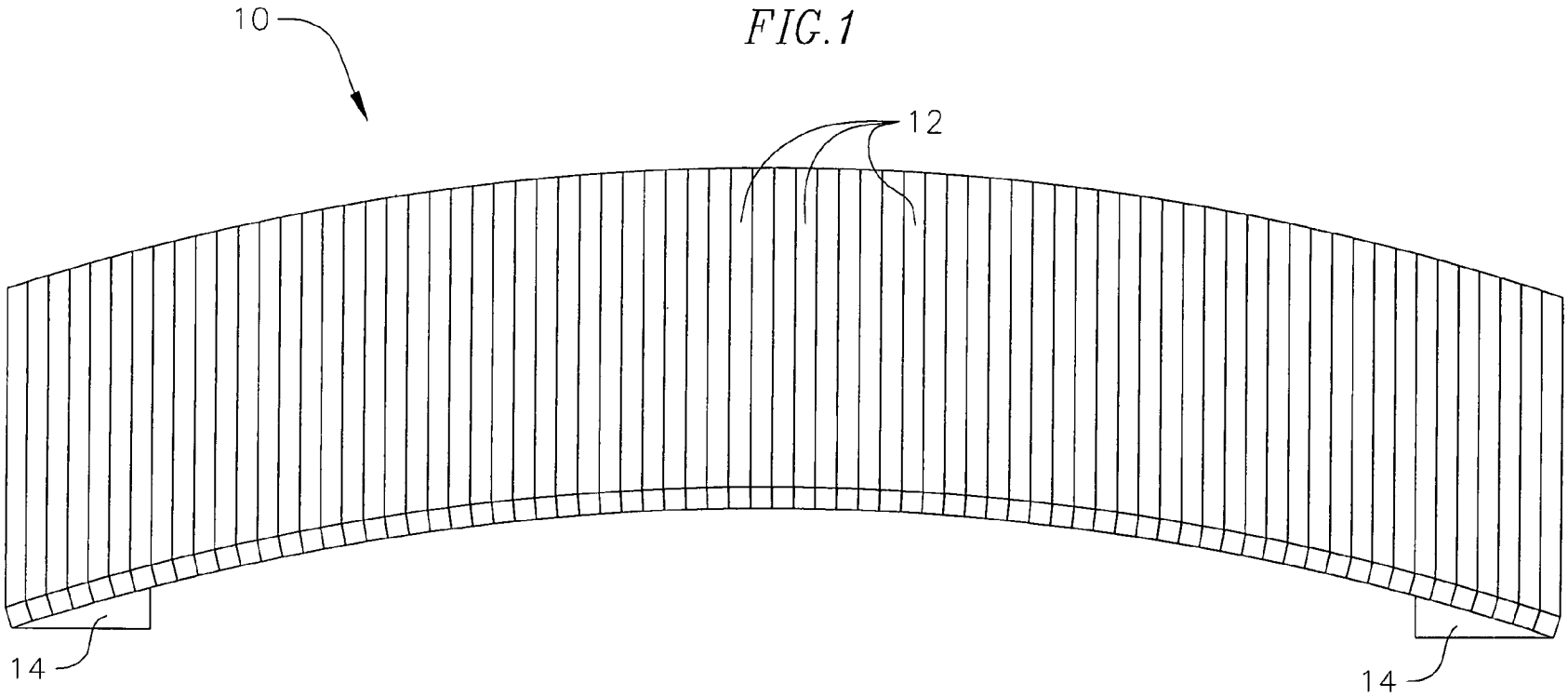
FIG. 1 is a perspective view of one embodiment of the present invention.
Figure 2:
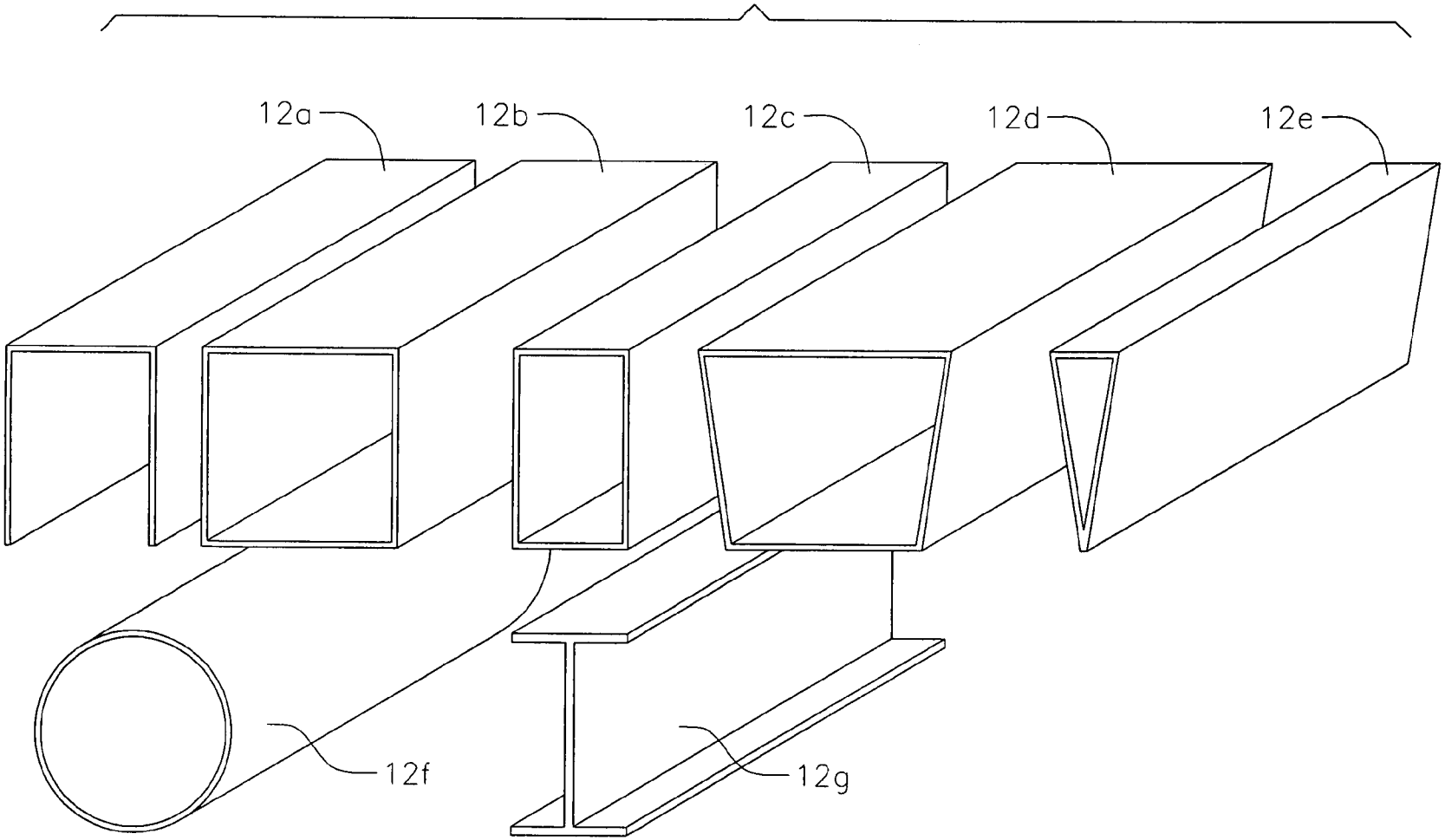
FIG. 2 is a schematic view of the geometry of individual bridge elements.

Referring to FIG. 1, a mobile compression and tension bridge 10 of the present invention is illustrated. The bridge 10 comprises a plurality of bridge elements 12 which are connected to one another by a tension member, which is discussed in more detail subsequently herein. The bridge elements 12 are connected in a side-by-side fashion and they are adapted to form an arch when they are extended outwardly from base members 14. As can be seen in FIG. 1, the cross-sectional configuration of the individual bridge elements is square, however as can be shown in FIG. 2, the bridge elements 12 can have a variety of cross-sectional geometric configurations such as U-shaped 12*a*, square 12*b*, rectangular 12*c*, trapezoidal 12*d*, triangular 12*e*, circular 12*f* or I-beam 12*g*. It is to be understood that these geometrical configurations are by way of example and are not to be so limited since other geometric configurations may also be suitable for a particular application.

Figure 3:
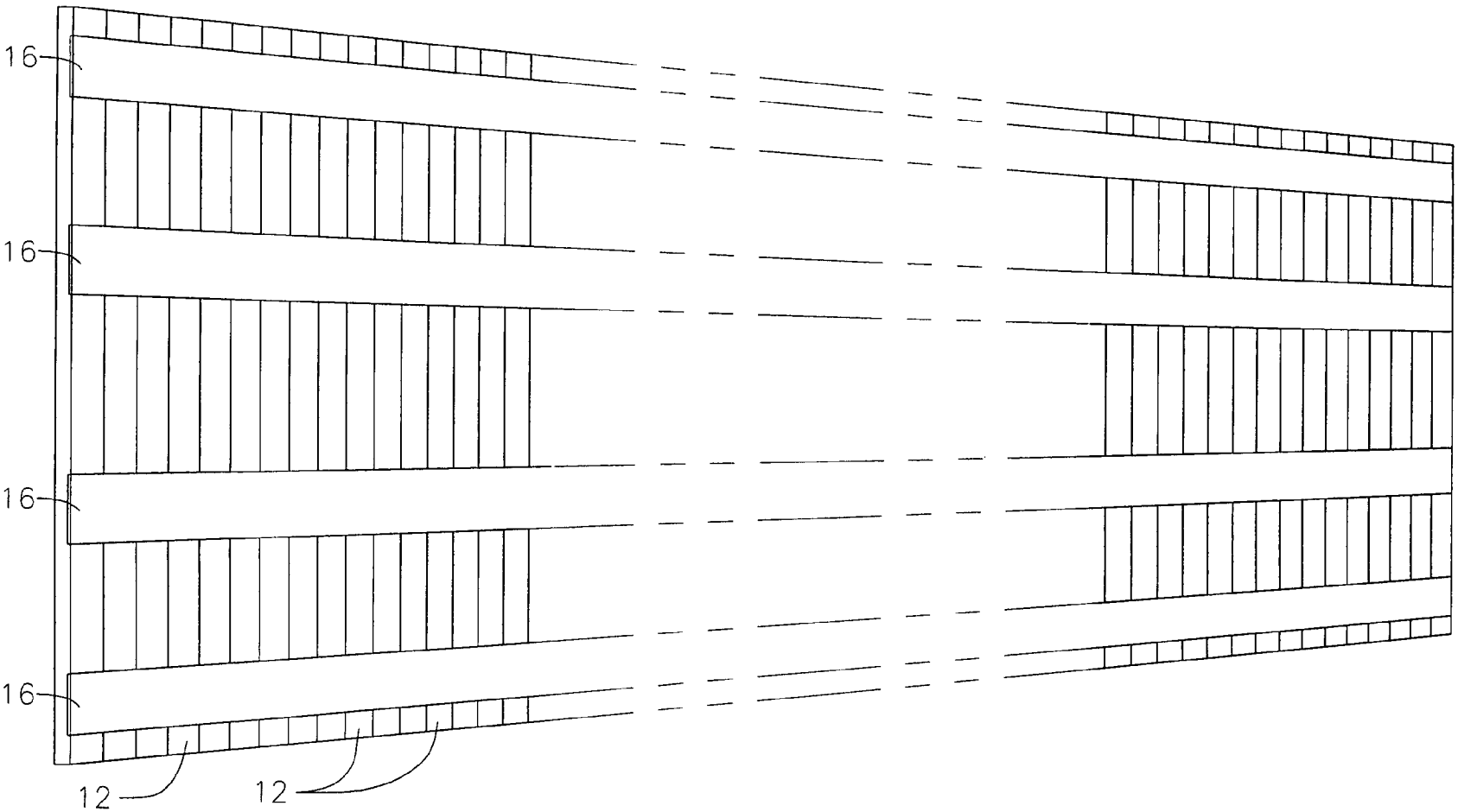
FIG. 3 is a bottom view of the bridge structure of the present invention illustrating a first tension device.

As shown in FIGS. 3 and 4, the individual bridge elements are attached to each other and held by a tension device 16 located on a bottom surface of the bridge elements. Preferably more than one tension device 16 are positioned along the lower surface of the bridge elements. FIG. 3 illustrates four metal strips spaced along the lower surface of the bridge elements and FIG. 4 illustrates two metal strips spaced apart along the lower surface the bridge elements. It is to be understood that any number of tension members can be located along the lower surface of the bridge element depending upon the width of the structure for the overall application.

Figure 4A:
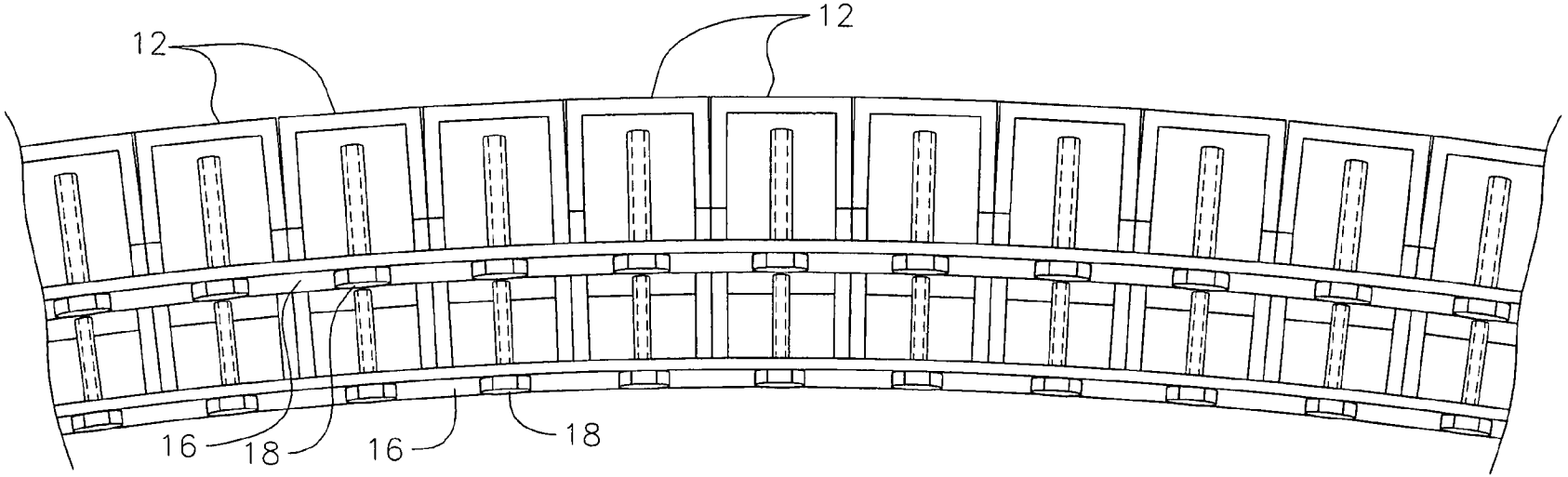
FIG. 4A is a bottom perspective view of a second embodiment of the present invention.
Figure 4B:
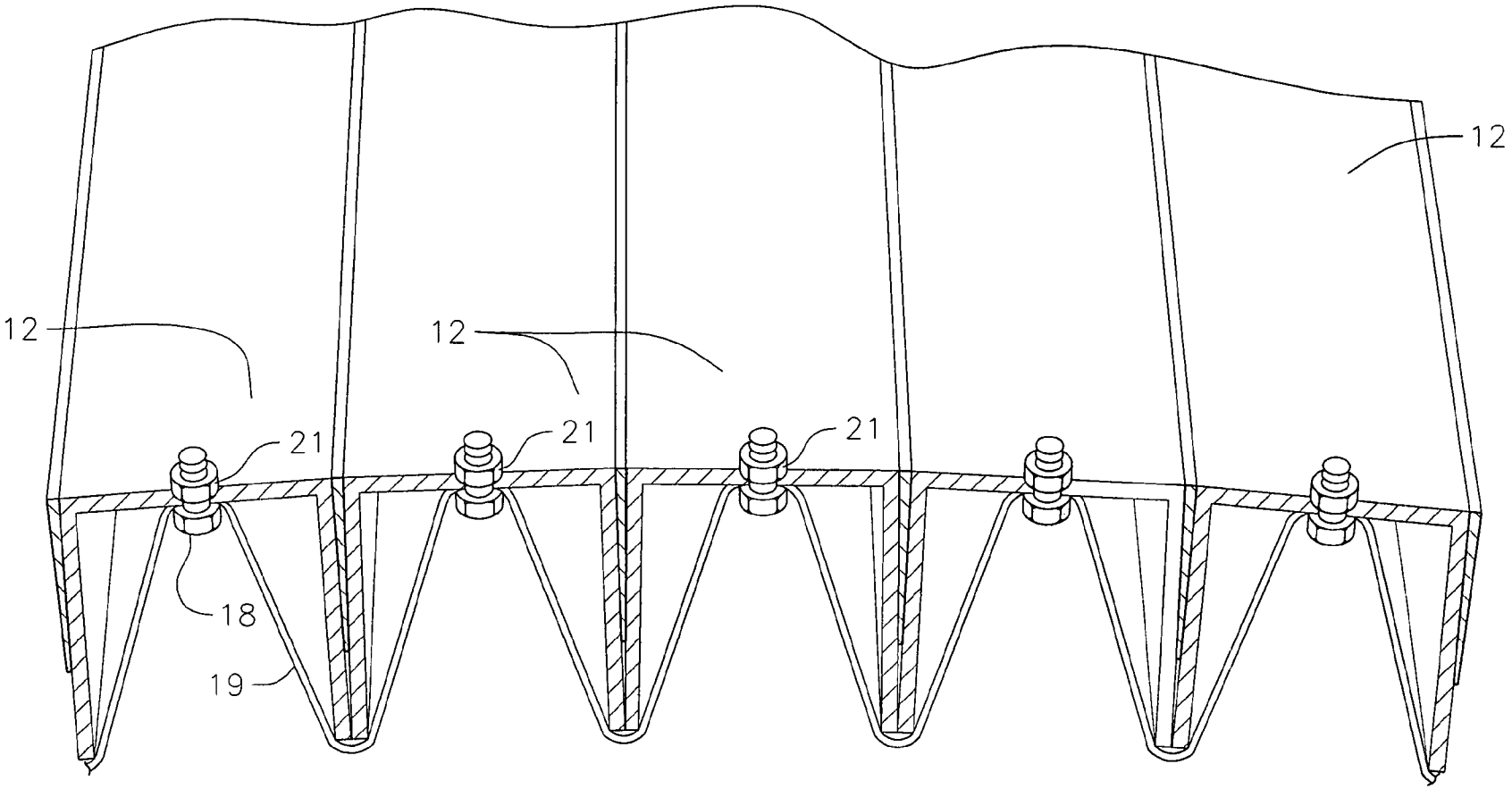
FIG. 4B is a cross-sectional side view of the embodiment of FIG. 4A with an alternative tension device.

As seen best in FIGS. 4A and 4B, the tension members are attached to each bridge element 12 by a fastener 18 which extends through the tension member and into the bridge element. By way of example, for bridge elements which are U-shaped, the fastener would extend through the tension member and through the upper surface of the bridge element. For a square bridge element, the fastener would extend through the tension member and the bottom surface and/or the top surface of the bridge element. The tension member connected along the bottom surface of the bridge element device allows the bridge elements to be flexible and rolled for transport or storage. The tension of FIG. 4A is a metal strap 16 and the tension device of FIG. 4B is a cable 19. Fastener 18 is a screw which is held in place by a nut 21.

Figure 5:
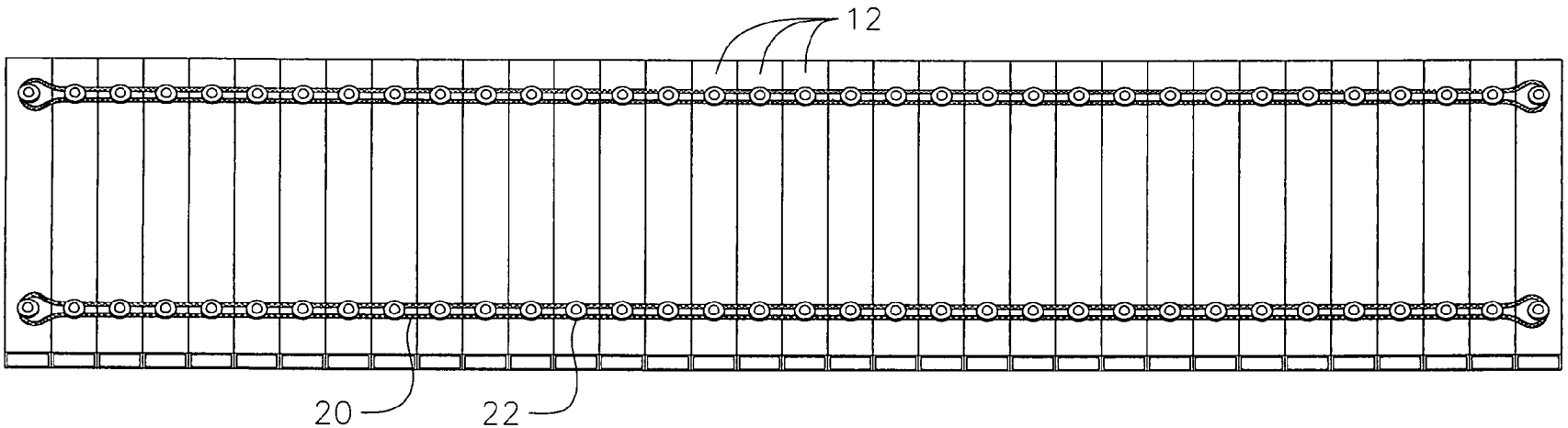
FIG. 5 is a bottom view of a third embodiment of the present invention.

FIG. 5 illustrates an alternative tension member which is a cable 20. Cable 20 is attached to each individual bridge element 12 by a fastener 22. Yet another tension member for connecting the individual bridge elements is a mesh 24 as shown in FIG. 7.

The mobile compression and tension bridge 10 of the present invention provides its own rigidity and stability for an extended bridge structure as weight is placed upon the bridge. As the bridge is loaded, the top part of the bridge elements will absorb compression forces and the tension members at the bottom of the bridge elements will absorb the tension forces. As the bridge carries a heavier load, the arch shape will become flatter and the tension members will bear more and more of the load. As the arch becomes more flat, the supporting ends of the bridge will move outward. When the load is removed from the bridge, the bridge may resume its original arch form and the supporting end components will move inward. Optionally, beams can be placed on the top surface of the bridge compressed from one end to another when the bridge is fully loaded to maintain the structure permanently in a compressed position. Further optional components can be used with the bridge structure such as railing, which could be an L-shaped post positioned in the opening at the end of the bridge element, securing it with bolts and connecting the tops of these posts by a rope or a cable to create a railing. These railings could be connected to each other with diagonal cables and create another method to sustain the bridge permanently in one position.

Figure 6:
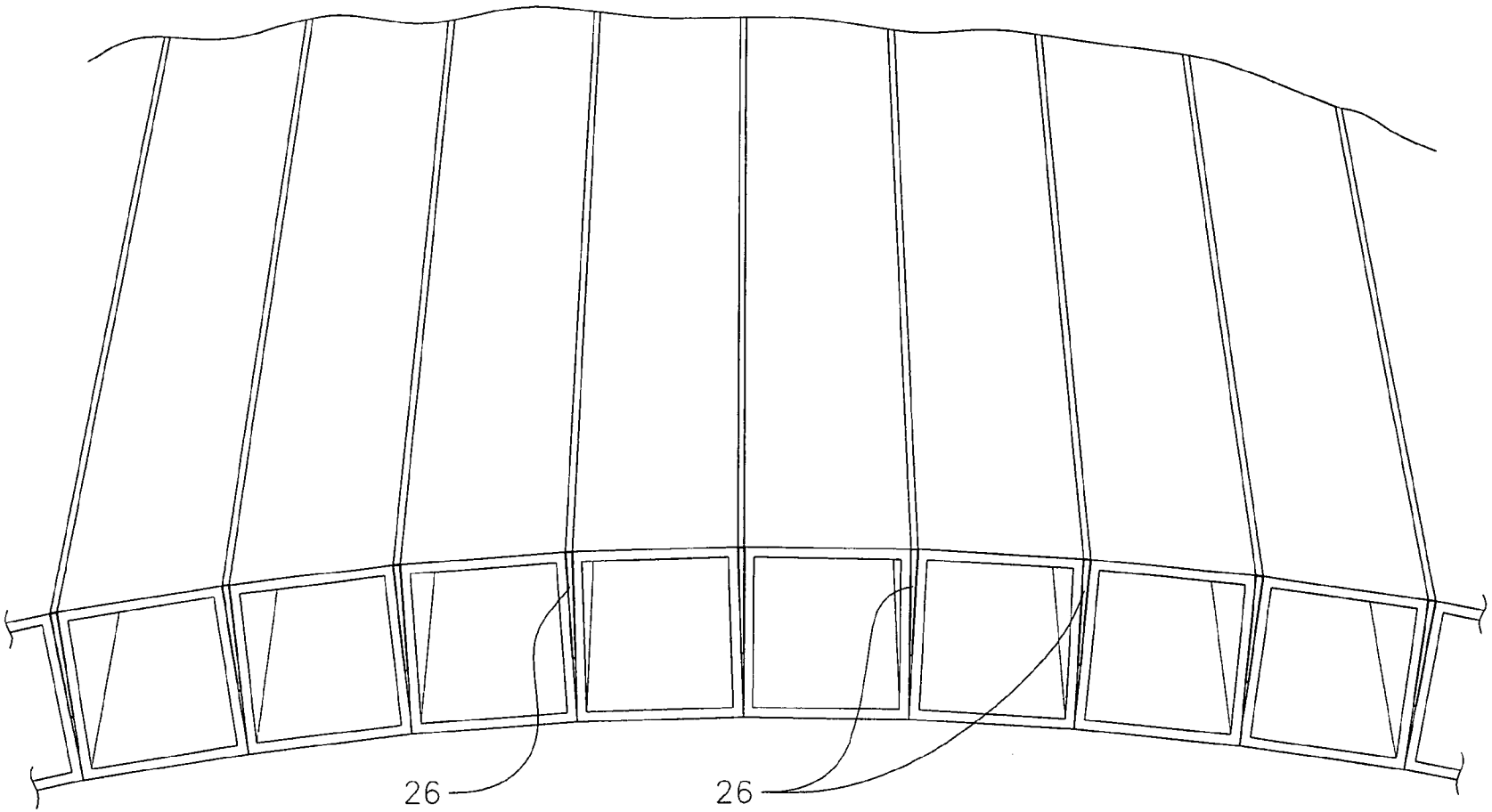
FIG. 6 is a side view of the embodiment of FIG. 1.

In order for the bridge elements to form an arcuate contour in an extended position, the bottom of each individual bridge element could have a width shorter than the top portion of each element, i.e. trapezoidal, or narrow inserts 26 as shown in FIG. 6 could be placed between the individual bridge elements towards the top of the elements to form the arch. Generally speaking, the length of each element is in the range of about three to fifty feet long, and the width ranging between three inches to ten feet.

Figure 7:
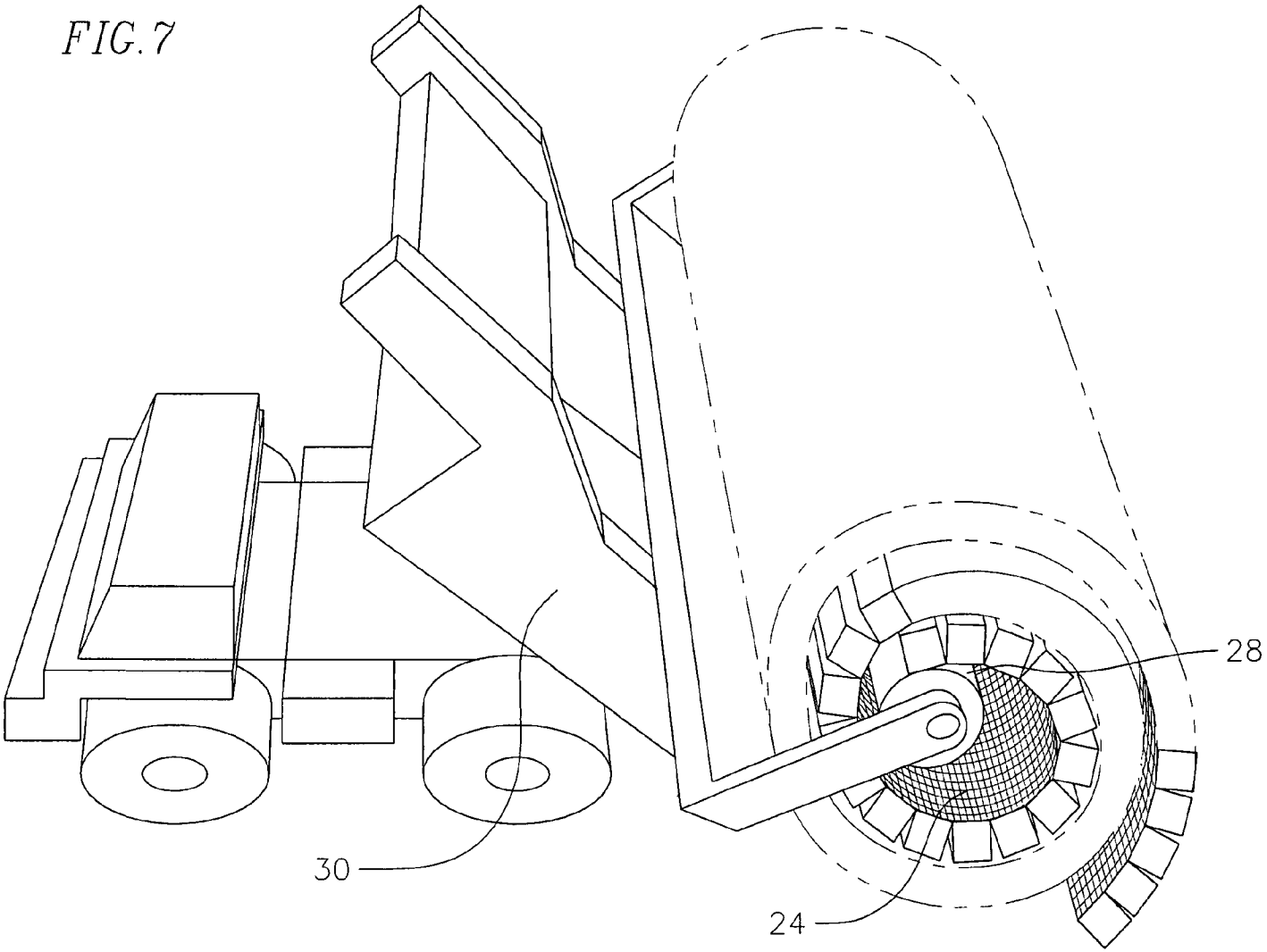
FIG. 7 is a side view illustrating one method of retracting the bridge device of the present invention and storing the bridge on a reel.

Because of the ability to be flexible, the bridge structure can be rolled onto a reel 28 as shown if FIG. 7. Once rolled onto a reel, the bridge structure occupies less space as it is coiled onto the reel and becomes transportable. The distance which an extended bridge structure is capable of spanning is dependent upon the size of the individual elements. Generally speaking, the bridge is adapted to span distances of about ten to two-hundred feet, or more. Preferably, the bridge elements are made of wood, plastic, metal or carbon fiber material where strength and lightweight are required. The fasteners used to attach the tension member to the bridge elements could be screws, bolts, rivets, clamps, hooks or other bonding methods, such as welding or glue.

The transport reel 28 is preferably circular and constructed of metal, plastic or composite fiber. The reel may be driven by a motor or include a crank to be manually actuated. The entire device may be mounted on a trailer to be towed or positioned on a truck bed 30 as shown in FIG. 7.

Figure 8:
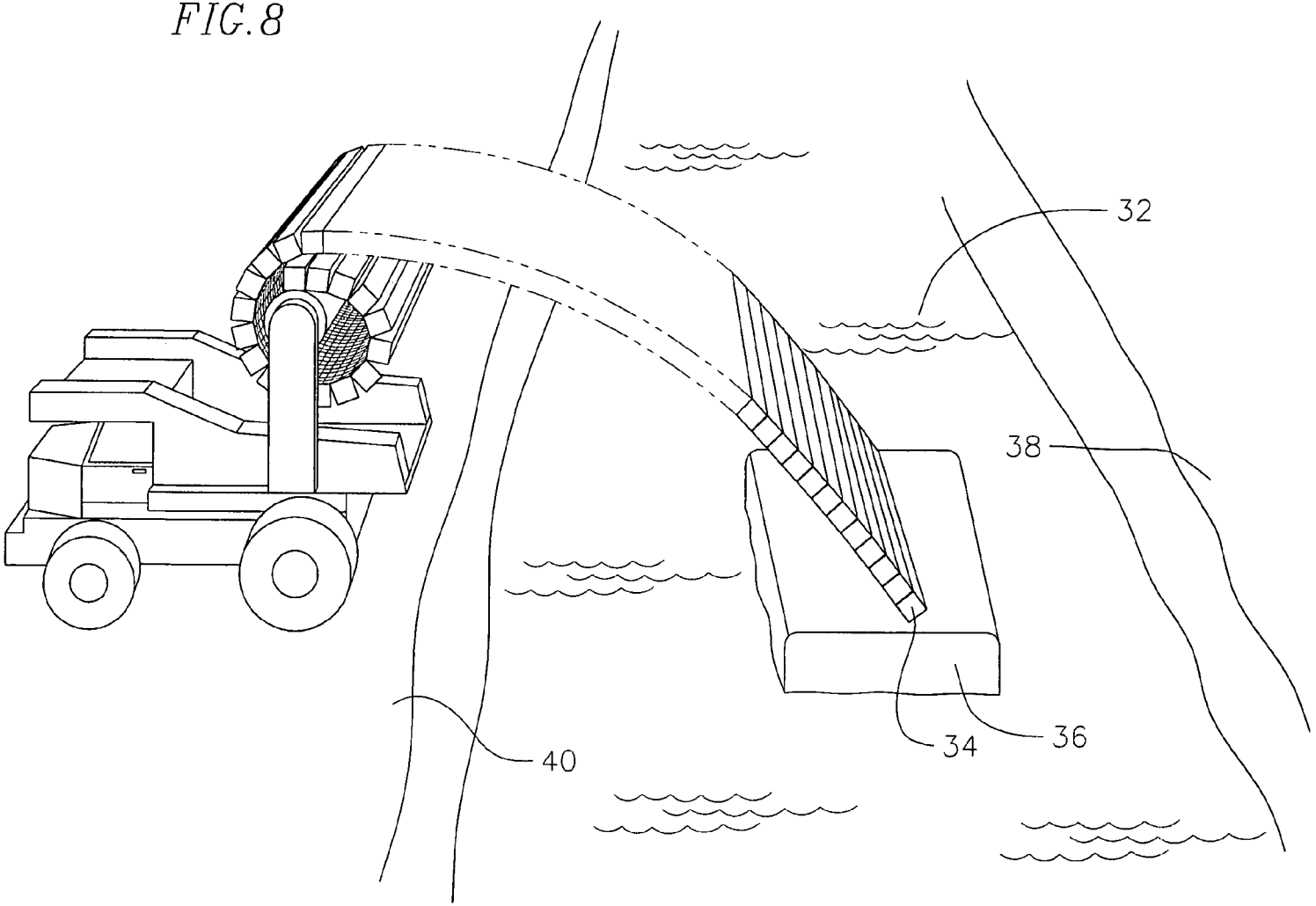
FIG. 8 is a schematic view of a first method of deploying the bridge device of the present invention.
Figure 9:
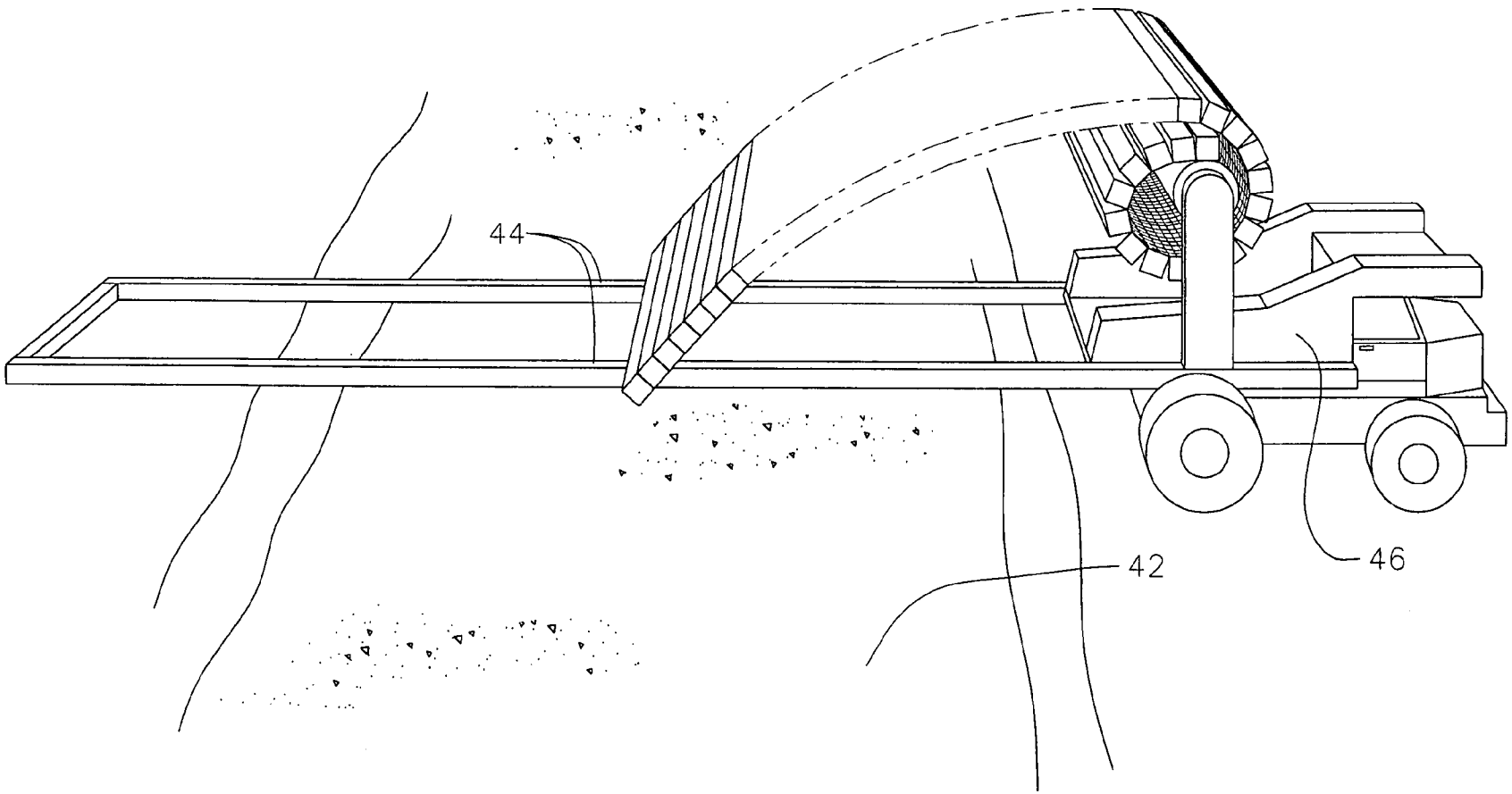
FIG. 9 is a schematic view of a second method of deploying the bridge device of the present invention.

As shown if FIG. 8, to span a body of water 32 an end 34 of the bridge can be placed on a pontoon 36 and floated across the water to bank 38. The opposite end of the bridge would then be positioned on bank 40. Referring to FIG. 9 the bridge could be deployed over a ravine 42 by having telescoping rails 44 extending from truck 46 and the bridge unwound and slid across the rails until reaching land. To bridge over water, a bridge made of sealed tubes could be unrolled and floated over the water in any orientation. Once reaching the opposite bank, it could be positioned accordingly. In a configuration where the bridge is floating, it could be pulled from one location on the water to another. This could have useful application in flooded areas. If one or more of the individual bridge elements are damaged, they could be replaced on site.

Figure 10:
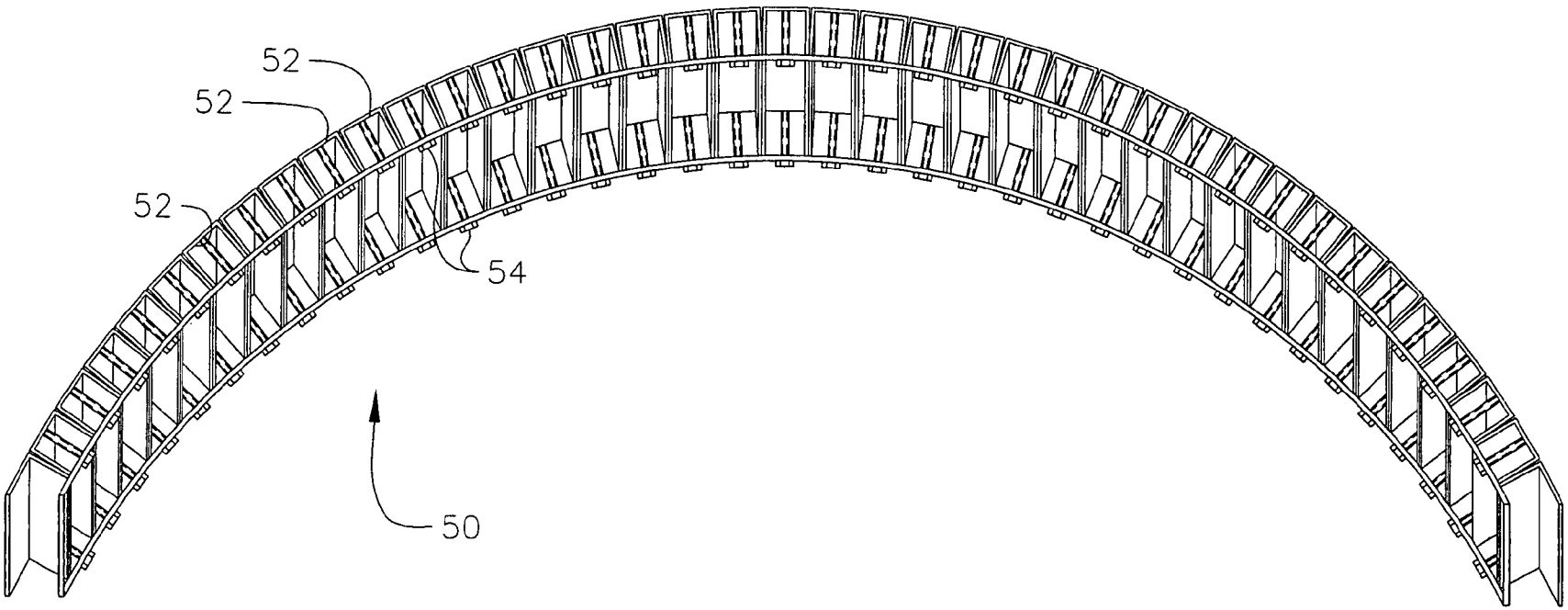
FIG. 10 is a perspective view of the present invention as a shelter.

FIG. 10 illustrates the invention utilized as a shelter structure 50. In this embodiment, the individual elements 52 are held in a much more significant arch by larger inserts between the elements. The arch has a sufficient height that it can accommodate occupants or equipment below the arch or be placed between walls.

While the present invention has been shown and described in terms of multiple embodiments thereof, it will be understood that this invention is not to be limited and that changes and modifications can be made without departing from the scope of the invention as hereinafter claimed.

What is claimed is:

1. A free-standing mobile compression and tension structure comprising:

a plurality of parallel structural elements, wherein adjacent parallel structural elements are in contact with each other while in a free-standing state, said plurality of parallel structural elements being perpendicular to a length of the structure;

means for absorbing a tension between each adjacent structural element as a compression load is applied to an upper portion of the adjacent structural elements and for preventing said adjacent structural elements from separating, said means being a tension device that is rigidly secured to an intermediate portion of a lower surface of each adjacent structural element such that said tension device is under a tension load while said structure is in said free-standing state;

each of said adjacent structural elements having an upper portion width that is larger than a lower portion width; and said structure being configured as an arch in its free-standing state.

2. The structure of claim 1, wherein the structural elements comprise a plurality of consecutive linked segments which become firmer as load is placed upon the structural elements.

3. The structure of claim 1, wherein the structural elements are adapted to pivot against each other in one plane.

4. The structure of claim 1, wherein the tension device is a strap.

5. The structure of claim 1, wherein the tension device is a cable.

6. The structure of claim 1, wherein the tension device is mesh.

7. The structure of claim 1, wherein the tension device is attached to each structural element by a fastener.

8. The structural device of claim 1, wherein the tension device is attached to the structural elements by welding or glue.

9. The structure of claim 1, further including a reel for storage of the device.

10. The structure of claim 9, wherein the reel is mounted on a transport vehicle.

11. The structure of claim 10, wherein the transport vehicle includes a telescoping arm for deployment of the structure.

12. The structure of claim 9, wherein the structure further includes an inflatable pontoon for deployment of the structure.

13. The structure according to claim 1, further comprising a wedge-shaped generally flat spacer positioned between adjacent structural elements adjacent a top surface of the structural elements.

14. A free-standing compression and tension bridge comprising:

a plurality of parallel structural elements, wherein adjacent parallel structural elements are in contact with each other while in a free-standing state, said plurality of parallel structural elements being perpendicular to a length of the structure;

means for absorbing a tension between each adjacent structural element as a compression load is applied to an upper portion of the adjacent structural elements and for preventing said adjacent structural elements from separating, said means being a tension device that is rigidly secured to an intermediate portion of a lower surface of each adjacent structural element such that said tension device is under a tension load while said structure is in its free-standing state;

said structure being configured as an arch shape in its free-standing configuration; and a wedge-shaped generally flat spacer is positioned between each adjacent structural element so as to maintain a separation of said upper portion of each adjacent structural element when under compression and so as to maintain the structure in said arch shape.

15. The bridge of claim 14, wherein the tension device is a strap.

16. The bridge of claim 14, wherein the tension device is a cable.

17. The bridge of claim 14, wherein the tension device is mesh.

* * * * *